US011452660B2

(12) United States Patent
Bristol

(10) Patent No.: US 11,452,660 B2
(45) Date of Patent: Sep. 27, 2022

(54) APPARATUS AND METHOD OF TRAINING HUMAN BRAIN AND BODY TO WALK USING MODULAR AN EXOSKELETON

(71) Applicant: Arizona Board of Regents on Behalf of the University of Arizona, Tucson, AZ (US)

(72) Inventor: Hermelinda Bristol, Tucson, AZ (US)

(73) Assignee: Arizona Board of Regents on Behalf of the University of Arizona, Tucson, AZ (US)

( * ) Notice: Subject to any disclaimer, the term of this patent is extended or adjusted under 35 U.S.C. 154(b) by 436 days.

(21) Appl. No.: 16/392,515

(22) Filed: Apr. 23, 2019

(65) Prior Publication Data

US 2019/0321250 A1 Oct. 24, 2019

Related U.S. Application Data

(60) Provisional application No. 62/661,555, filed on Apr. 23, 2018.

(51) Int. Cl.
*A61H 3/00* (2006.01)

(52) U.S. Cl.
CPC ..... *A61H 3/00* (2013.01); *A61H 2003/007* (2013.01); *A61H 2201/164* (2013.01); *A61H 2201/1623* (2013.01); *A61H 2201/1628* (2013.01); *A61H 2201/1633* (2013.01); *A61H 2201/1642* (2013.01); *A61H 2201/1671* (2013.01); *A61H 2203/0418* (2013.01)

(58) Field of Classification Search
CPC ..... A61H 3/00; A61H 2003/007; A61H 2201/1623; A61H 2201/1628; A61H 2201/1633; A61H 2201/164; A61H 2201/1642; A61H 2201/1671; A61H 2203/0418; B25J 9/0006
See application file for complete search history.

(56) References Cited

U.S. PATENT DOCUMENTS

2015/0025423 A1* 1/2015 Caires ..... A61H 3/00 601/35
2015/0057587 A1* 2/2015 Walsh ..... A63B 53/10 602/16
2015/0351995 A1* 12/2015 Zoss ..... B25J 9/0006 623/32
2016/0128890 A1* 5/2016 LaChappelle ..... A61F 2/70 623/30
2019/0344456 A1* 11/2019 Baptista ..... B25J 9/0006

* cited by examiner

*Primary Examiner* — Timothy A Stanis
(74) *Attorney, Agent, or Firm* — Keith A. Vogt; Keith Vogt, Ltd.

(57) ABSTRACT

A system and method to assist a user to overcome an interruption of service between the brain and the legs including several subsystems configured to be progressively removed to provide decreasing levels of lower trunk and leg support.

16 Claims, 8 Drawing Sheets

APPARATUS AND METHOD OF TRAINING HUMAN BRAIN AND BODY TO WALK USING MODULAR AN EXOSKELETON

RELATED APPLICATIONS

This application claims priority to U.S. Provisional Application Ser. No. 62/661,555 filed on Apr. 23, 2018, which is hereby incorporated in its entirety.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

Cerebral Palsy, abbreviated as CP, is a disorder that affects muscle tone, movement, and motor skills due to abnormal brain development. This causes exaggerated contraction of the muscles, unyielding limbs, and at times involuntary movements. Patients with such disorders need a variety of therapies and often most overcome several challenges one of which is standing and walking independently. Both actions require developed motor function and muscle strength. By not standing and walking, the patient is at risk for loss of motor function and muscle atrophy. As such, a patient needs methods and apparatus to ameliorate these effects.

BRIEF SUMMARY OF THE INVENTION

In one embodiment, the present invention provides a system and method that addresses a patient's physical needs, such as learning to maintain balance and posture.

In other embodiments, the present invention provides a system and method that include an exoskeleton that allows a patient with cerebral palsy to learn to stand and walk. The exoskeleton aids in the correction of gait, stabilizes the core and leg muscles while walking, and properly engages pertinent muscles in movement and exercise.

In other embodiments, the present invention provides a system and method that include a motorized or non-motorized walking assist system/device for persons who have balance issues (functional nervous and muscles but impaired brain signals) whereby the system is modular and progressive in nature allowing the user to have a range of support from the lower back to the bottom of the foot. The system and method are configurable to provide decreasing levels of lower trunk and leg support to train the brain to properly signal and engage the muscles to function normally.

In other embodiments, the present invention provides a system and method that include a modular combination of a rigid back, external leg and foot supports, and body fasteners. The components are configured in such a way as to prevent the back, hips, legs, calves, and feet from deviating from a normal walking pattern.

In another embodiment, the present invention provides a system and method to assist a user having adequately functioning muscles and leg nerves to overcome an interruption of service between the brain and the legs to perform functions such as walking, comprising the steps of: providing modular components configured to be progressively removed to provide decreasing levels of lower trunk and leg support.

In another embodiment, the present invention provides a system and method wherein the modular system is comprised of a waist support, upper leg, lower leg and foot subsystems.

In another embodiment, the present invention provides a system and method wherein the waist support subsystem is first removed.

In another embodiment, the present invention provides a system and method wherein the upper leg subsystem is next removed.

In another embodiment, the present invention provides a system and method wherein the lower leg subsystem is next removed.

In another embodiment, the present invention provides a system and method wherein the foot subsystem is next removed.

In another embodiment, the present invention provides a system and method wherein the subsystems keep a patient's feet from spreading apart and/or crossing over.

In another embodiment, the present invention provides a system and method wherein the waist-support subsystem includes a rigid extension to provide core support to maintain balance in a standing position.

In another embodiment, the present invention provides a system and method wherein the waist-support subsystem includes rigid and non-rigid components to provide hip support that allows for hip extension and flexion.

In another embodiment, the present invention provides a system and method wherein the waist-support subsystem articulates with the upper leg subsystem to allow for movement.

In another embodiment, the present invention provides a system and method wherein the upper leg subsystem engages the leg adductors muscles by providing resistance in the inner thigh area.

In another embodiment, the present invention provides a system and method wherein the upper leg subsystem includes nonrigid components that work together with the rigid components.

In another embodiment, the present invention provides a system and method wherein the upper leg subsystem allows for up to 12 degrees of tightness in hip flexion.

In another embodiment, the present invention provides a system and method wherein the upper portions of the upper leg subsystem articulate with the back-support subsystem to allow for hip motion.

In another embodiment, the present invention provides a system and method wherein the upper leg subsystem allows for up to 12 degrees of tightness in knee bend.

In another embodiment, the present invention provides a system and method wherein the lower portions of the upper leg subsystem articulate with the lower leg to allow for knee bending motion.

In another embodiment, the present invention provides a system and method wherein the lower leg subsystem allows for up to 12 degrees of tightness in knee bend.

In another embodiment, the present invention provides a system and method wherein the upper portions of the lower leg subsystem articulate with the upper leg subsystem to allow for knee bending motion.

In another embodiment, the present invention provides a system and method wherein the lower leg subsystem allows for ±10 degrees of plantarflexion and dorsiflexion.

In another embodiment, the present invention provides a system and method wherein the lower portions of the lower leg subsystem articulate with the foot subsystem to allow for ankle motion.

In another embodiment, the present invention provides a system and method wherein the foot subsystem allows for ±10 degrees of plantarflexion and dorsiflexion.

In another embodiment, the present invention provides a system and method further including a bearing system that preserves anatomical integrity of the patient during use and assists each subsystem to articulate while allowing for desired swinging motion at each joint.

In another embodiment, the present invention provides a system and method wherein the system provides core support to maintain balance in a standing position.

In another embodiment, the present invention provides a system and method wherein the system provides hip support for the patient that will allow for hip extension and hip flexion.

In another embodiment, the present invention provides a system and method wherein the system engages leg adductor muscles by providing resistance in inner thigh area.

In another embodiment, the present invention provides a system and method wherein the system allows for up to 12 degrees of tightness in hip flexion.

In another embodiment, the present invention provides a system and method wherein the system allows for ±10 degrees of plantarflexion and dorsiflexion.

In another embodiment, the present invention provides a system and method wherein the waist support subsystem system further includes a rigid back support component with an upward extension that provides support up the small of the back, said waist piece subsystem also includes waist and glute components that resides primarily below the waist, on each side, and down into the glute region to train the brain to stand, rather than collapse (rotate the hip forward over your feet), as a leg moves forward in its gait.

In another embodiment, the present invention provides a system and method wherein the hip/glute support arrangement improves upon prior designs by providing hip and glute restriction to prevent user collapse when the user lifts their leg to walk.

In another embodiment, the present invention provides a system and method wherein the waist support subsystem is the first modular subsystem removed in sections with the upper back extension being the first component removed followed by the later removal of the waist/glute components.

It is to be understood that both the foregoing general description and the following detailed description are exemplary and explanatory only and are not restrictive of the invention, as claimed.

BRIEF DESCRIPTION OF THE DRAWINGS

In the drawings, which are not necessarily drawn to scale, like numerals may describe substantially similar components throughout the several views. Like numerals having different letter suffixes may represent different instances of substantially similar components. The drawings generally illustrate, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

In a preferred embodiment, the present invention provides a method and system using a modular combination of a rigid back, external leg and foot supports, and body fasteners all configured in such a way as to prevent the back, hips, legs, calves, and feet from deviating from a normal walking pattern. This structure provides core, back, and hip support as well as engages the leg adductor muscles to allow for an erect posture and proper forward positioning of the legs to facilitate a normalized gait pattern. The system may also provide a greater range of movement compared to the current models to enable standing and walking. Achievement of standing and walking allows for complementary actions, such as squatting.

Figure 1:
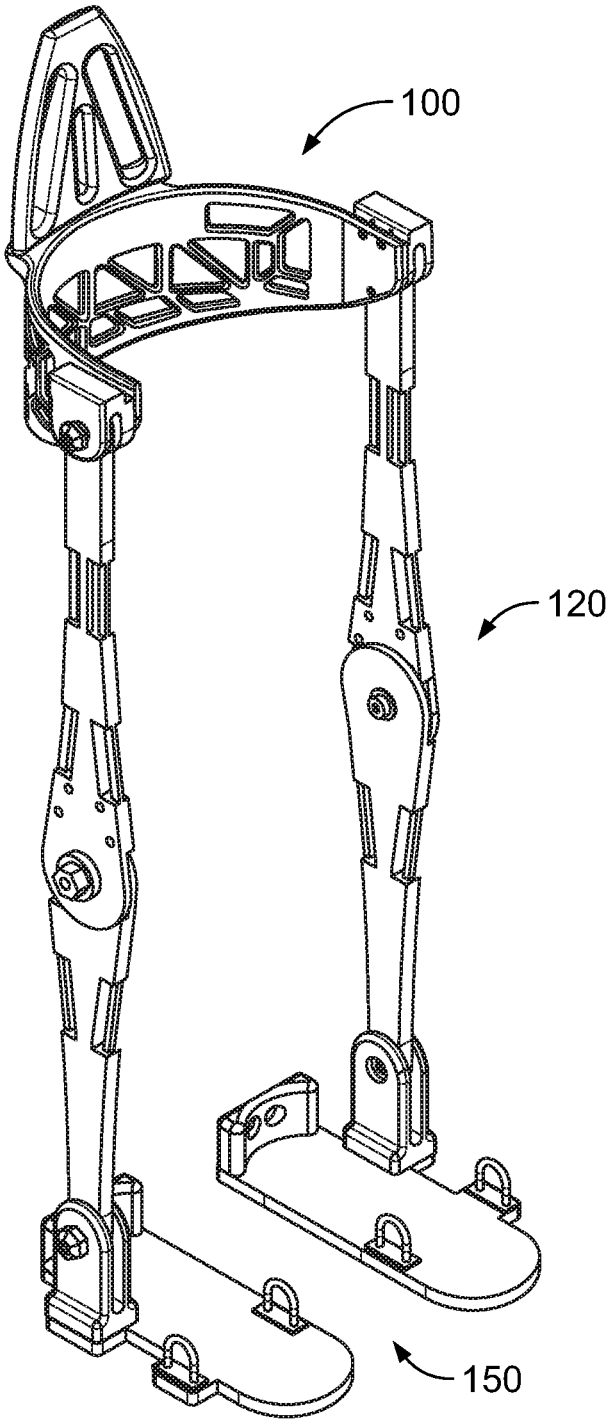
FIG. 1 illustrates a first embodiment of the present invention.
Figure 2:
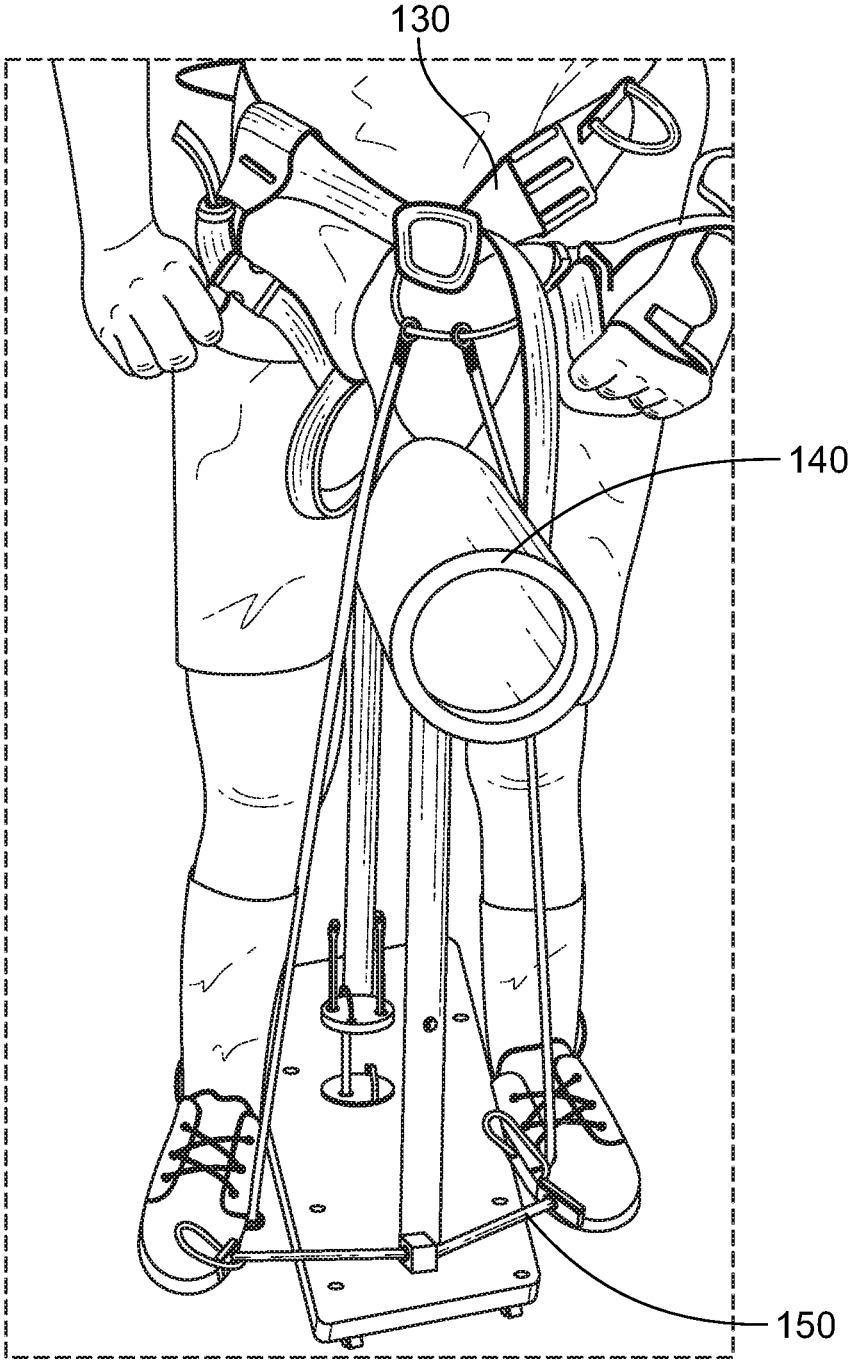
FIG. 2 illustrates a second embodiment of the present invention.

In one embodiment, the present invention, as shown in FIGS. 1- and 2, provides the following:

1. A back support 100 for the patient.
2. A core support 120 for the patient to maintain an upright position of the torso. The system shall also provide core support to maintain balance in a standing position.
3. A hip support 130 for the patient that will allow for hip extension and hip flexion.
4. Saddle or seat 140 to aid the patient to maintain and learn to maintain balance while performing tasks such as standing and walking.
5. Adaptations 150 to aid the patient to exercise and learn to exercise and engage adductor muscles in the legs. The system shall engage leg adductor muscles by providing resistance in inner thigh area 6. Adaptations to preserve anatomical integrity of the patient.
7. The system may be articulating to allowing for a range of motion such as walking, sitting, and standing.
8. The system shall allow for up to 12 degrees of tightness in hip flexion.
9. The system shall allow for up to 12 degrees of tightness in knee bend.
10. The system shall allow for ±10 degrees of plantarflexion and dorsiflexion.
11. The system is configured to prevent a user's feet from spreading apart and/or crossing over by providing two spaced apart foot restraints that maintain a fixed relationship during use.

Figure 3:
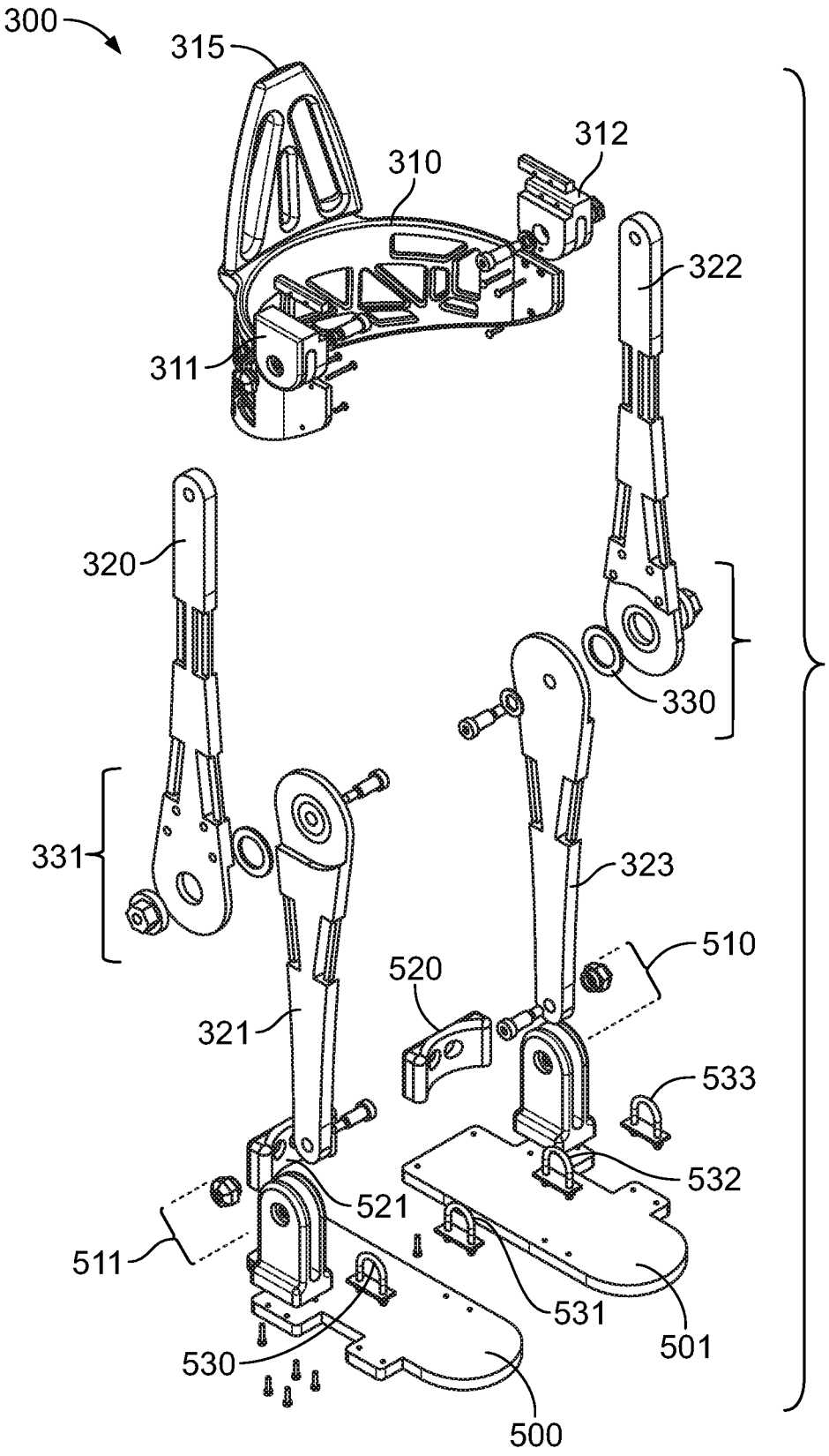
FIG. 3 is an exploded view of an embodiment of the present invention.

In other embodiments, as shown in FIG. 3, system 300 is configured to address the targeted locations. For example, waist support 310 may be a rigid structure that is curved to wrap around the waist to stabilize the hips. Spinal brace 315 vertically extends to engage the lower back. Connectors 311 312 are attached to support 310 and providing an articulating connection to leg supports 320-323. The leg supports may include hinge assemblies 330-331 that articulate so as allow a user to walk and/or otherwise bend their knees which will ultimately aid the patient in standing and walking and in learning to perform these tasks. Foot supports or restraints 500-501 may be connected to the leg supports by hinges 510-511 and further include heal supports/restraint 520-521 as well as eyelets or connection points for straps 530-533. The foot supports or restraints are spaced apart to maintain a fixed relationship during use. This prevents the patient from their spreading feet apart and/or crossing over while standing and walking. Ideally, this mechanism may be added near the hips rather than the feet so that a patient would not be restricted from walking in just one direction or favoring a particular side (left or right).

Figure 5:
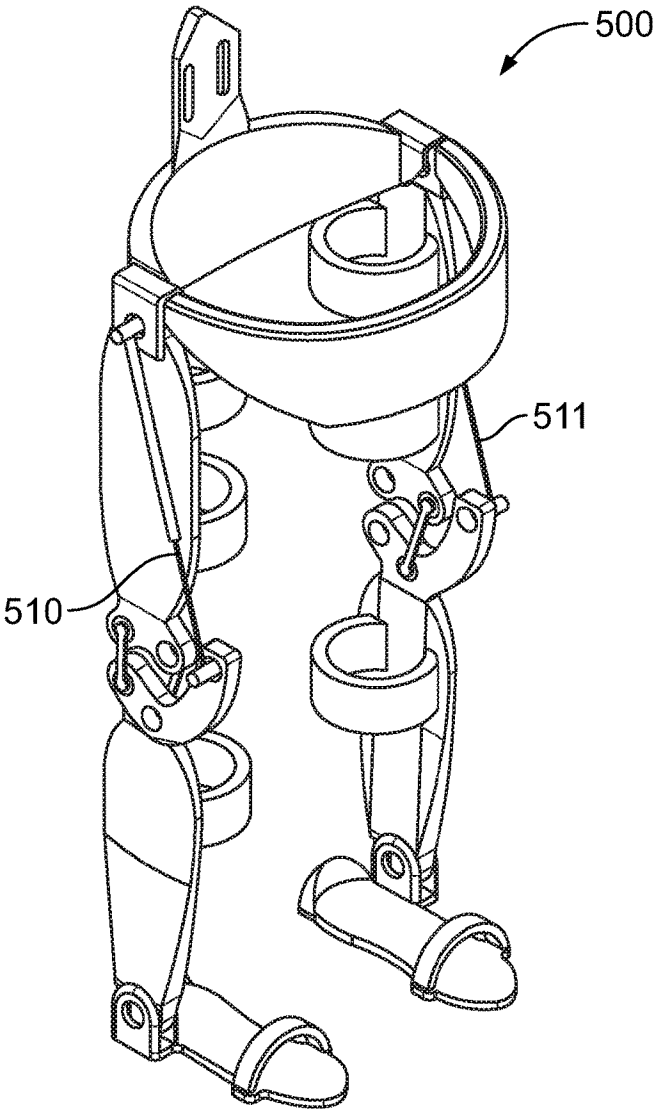
FIG. 5 illustrates how an embodiment of the present invention is used when a patient is standing.
Figure 4:
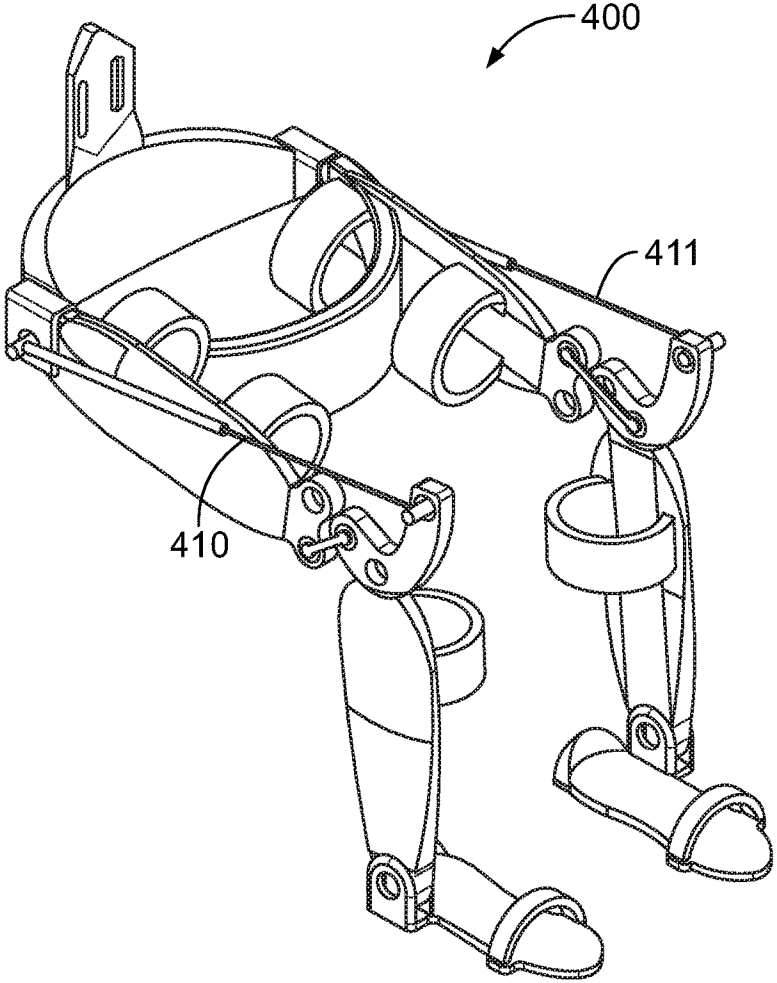
FIG. 4 illustrates how an embodiment of the present invention is used when a patient is sitting.
Figure 6:
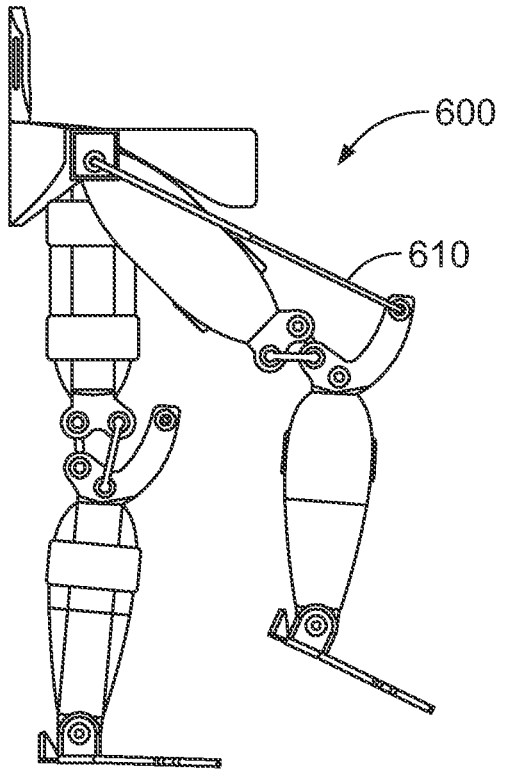
FIG. 6 illustrates how an embodiment of the present invention is used when the patient is walking.

As shown in FIG. 4 illustrates how system 400 is configured to allow use while a patient is sitting. FIG. 5 illustrates how system 500 is configured to allow use while a patient is standing. FIG. 6 illustrates how system 600 is configured to allow use while a patient is walking.

As further shown in FIGS. 4-6, in other embodiments of the present invention an energy source may be used in conjunction with the modular system. One particular energy source that may be used is one or more hydraulic actuators 410-411, 510-511 and 610 that supply pneumatic pressure and respond by converting this energy into mechanical motion. The actuators may be configured to be easily detachable from the system and used only when needed. The actuators would provide extra strength for the quad area and would also aid the caregiver in standing up the patient using the system on.

The energy sources may be used in other ways as well in other embodiments of the present invention. For example, the energy sources may act as therapeutic systems for the patient such as by creating resistance when walking and standing. This would allow the patient to gain strength when using actuators with different resistances. More possible add-ons can be incorporated for different needs such as modular footwear for different types of grip, spring system for increased resistance.

Figure 7:
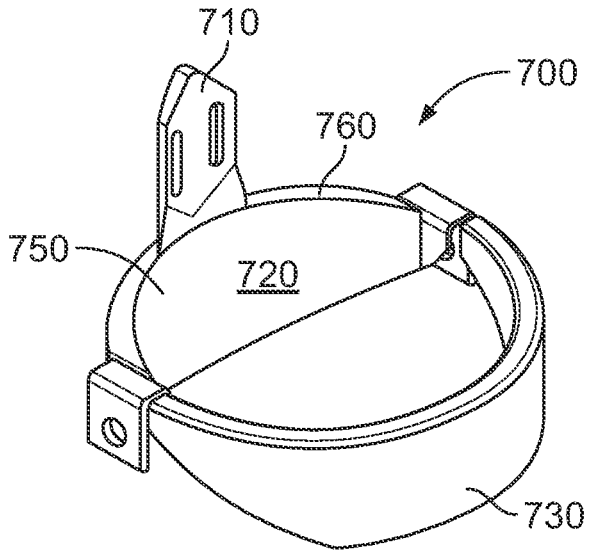
FIG. 7 illustrates a waist piece subsystem for an embodiment of the present invention.
Figure 8:
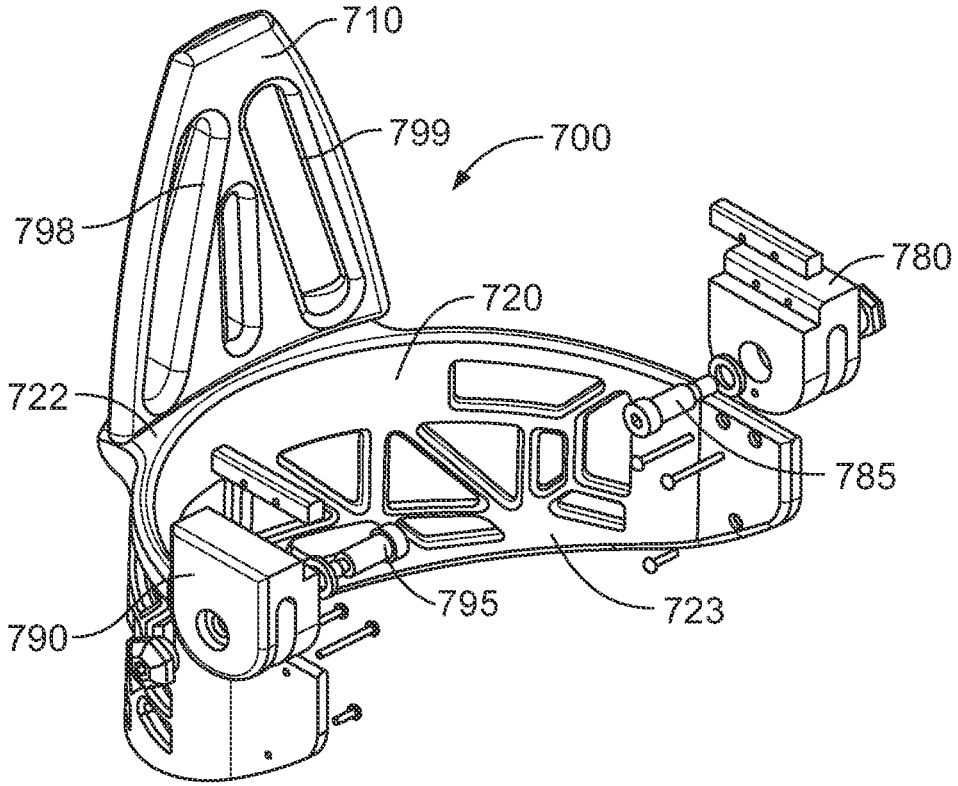
FIG. 8 illustrates an alternate waist piece subsystem for an embodiment of the present invention.

In a preferred embodiment, the present invention provides an exoskeleton which may be subsystems. FIGS. 7 and 8 illustrate a waist piece subsystem 700. The waist piece system provides back support for the patient. Rigid extension 710 in the center of the rigid piece 720 satisfies this requirement. The system provides core support to maintain balance in a standing position. Non-rigid support 730 may also be provided and it works with the rigid components to provides hip support that will allow for hip extension and flexion. The side extensions 750 and 760 of the waist piece system are curved to enhance the engagement with the user. Couplers 780 and 790 attached to upper leg supports which are discussed below. The couplers are arranged to allow the upper leg supports to pivot therein.

In other preferred embodiments, the waist piece system provides hip support that will allow for hip extension and flexion. The side extensions of the waist piece system will articulate with the leg supports to allow for movement. The rigid support 710 provides support up the small of the back but equally important, section 720 resides primarily below the waist, on each side, and down into the glute region to train the brain to stand, rather than collapse (rotate the hip forward over your feet), as a leg moves forward in its gait. This hip/glute support aspect improves upon prior designs by providing hip and glute restriction to prevent user collapse when the user lifts their leg to walk. Brackets 780 and 790 are attached to section 720 at the opposing ends to position pins 785 and 795 at or near the hip joint. The top edge 722 of section 720 is located above the hip joint and lower edge 723 engages the glute. Openings 798-799 provide hand holds.

Figure 9:
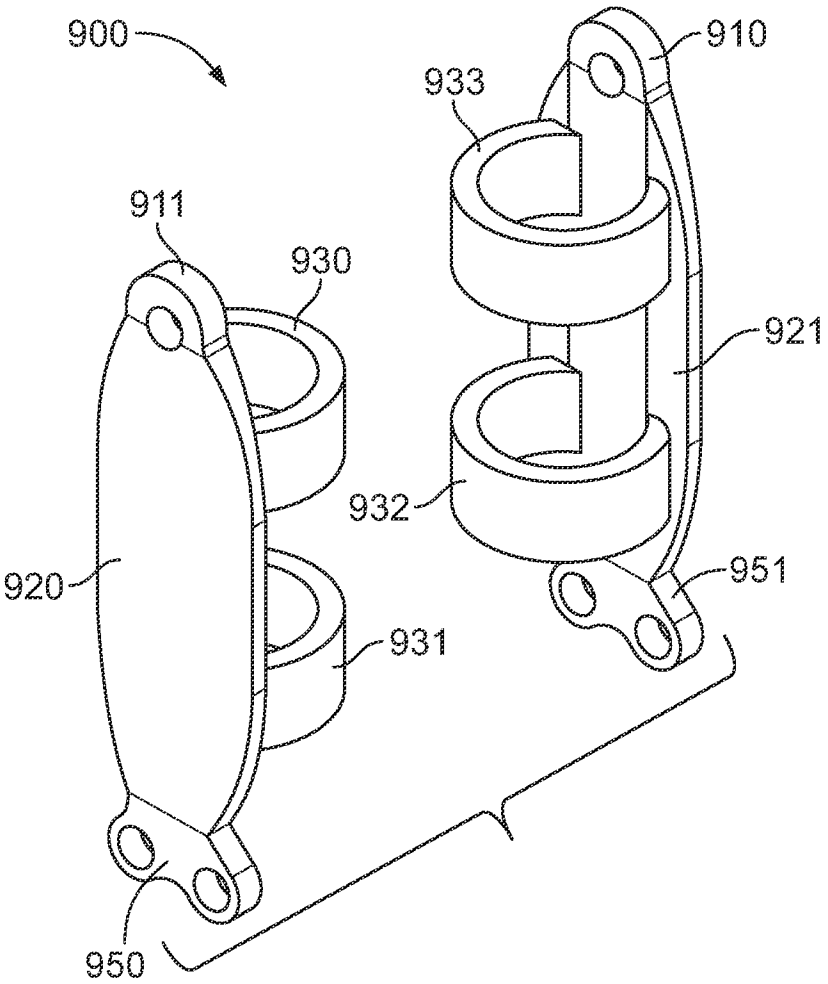
FIG. 9 illustrates an upper leg subsystem for an embodiment of the present invention.

FIG. 9 illustrates the upper leg subsystem 900. The upper leg system engages the leg adductors muscles by providing resistance in inner thigh area. Supports 920-921 and adjustable leg straps 930-933 work together and may allow for up to 12 degrees of tightness in hip flexion. Top sections 910 and 911 mate with couplers 780 and 792 allow the components to articulate thereby allowing hip motion. Upper leg system 900 may allow for up to 12 degrees tightness in knee bend. The bottom sections 950 and 951 on the paired components will articulate with Subsystem 3 to allow for knee bending motion.

Figure 10:
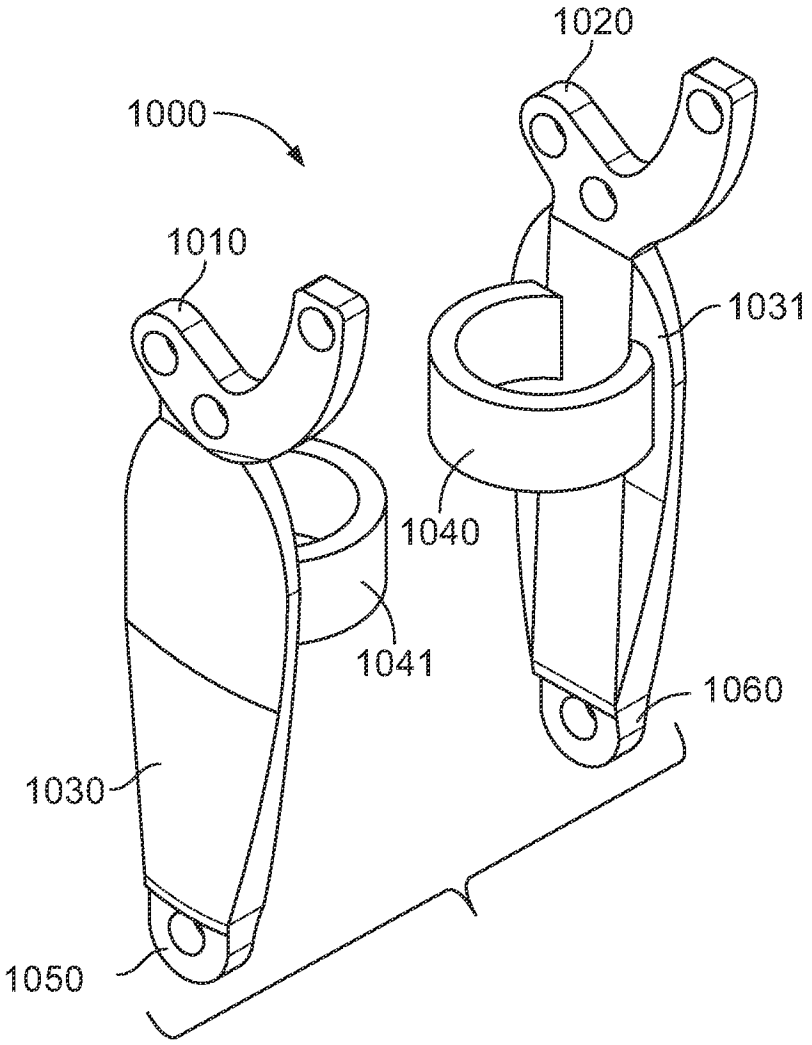
FIG. 10 illustrates an upper leg subsystem for an embodiment of the present invention.

FIG. 10 illustrates the lower leg subsystem 1000. The lower leg system may allow for up to 12 degrees tightness in knee bend. The top 1010 and 1020 pair with components 950 and 951 (FIG. 9) to form articulating connections that allow for knee bending motion. The lower leg system may allow for ±10 degrees of plantarflexion and dorsiflexion. The bottom 1050 and 1060 of the paired components articulates with foot restraint system 1200 (FIGS. 11 and 12) to allow for training of proper ankle motion and walking motions such as gaits and foot placement. Leg supports 1030-1031 and straps 1040-1041 are adapted to engage and support the lower legs of a user.

Figure 11:
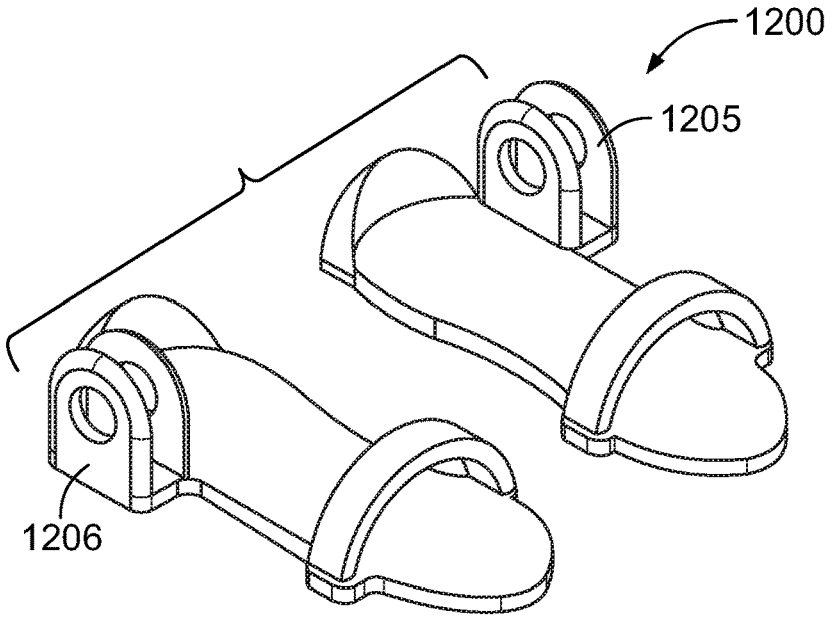
FIG. 11 illustrates a foot retention subsystem for an embodiment of the present invention.
Figure 12:
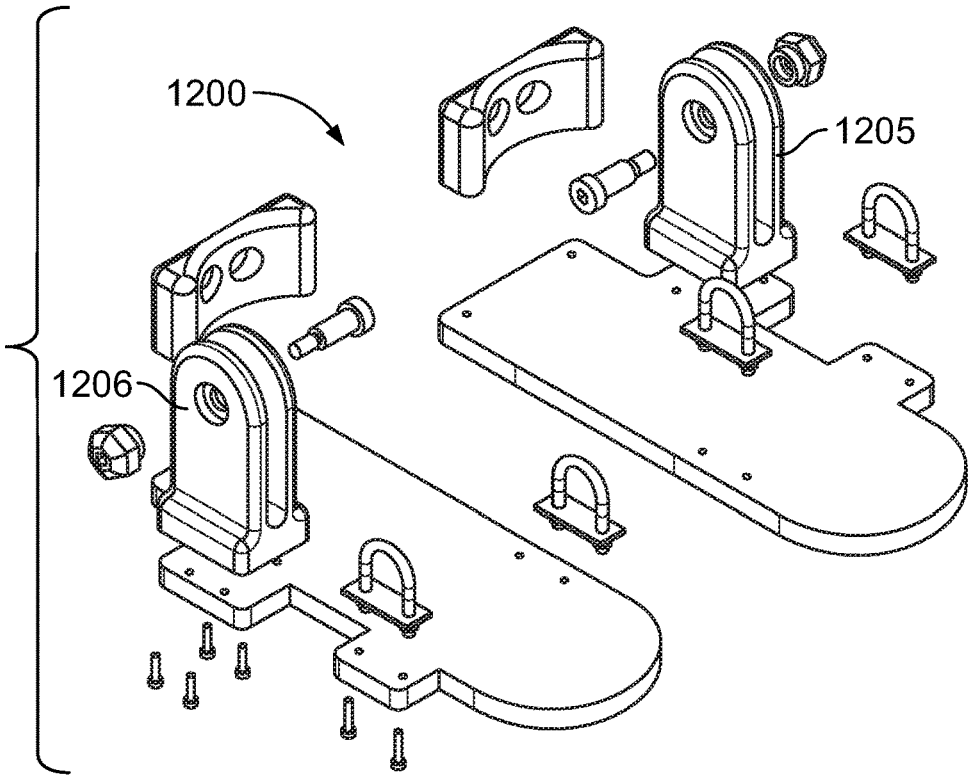
FIG. 12 illustrates an exploded view of a foot retention system for an embodiment of the present invention.

FIGS. 11 and 12 illustrate foot support and restraint system 1200. The foot system shall allow for ±10 degrees of plantarflexion and dorsiflexion. Side extensions 1205-1206 are designed to articulate with the lower leg support system 1000 to create an articulating connection that will allow and train proper ankle movement.

The foot subsystem may also be configured to provide a sliding motion on a surface to provide ease of movement for further training and solidifying the desired movement to be trained. This allows for training of longer gaits and proper heel strikes. The foot system also assists in preventing the ankles from turning in and training of the proper position.

Figure 13:
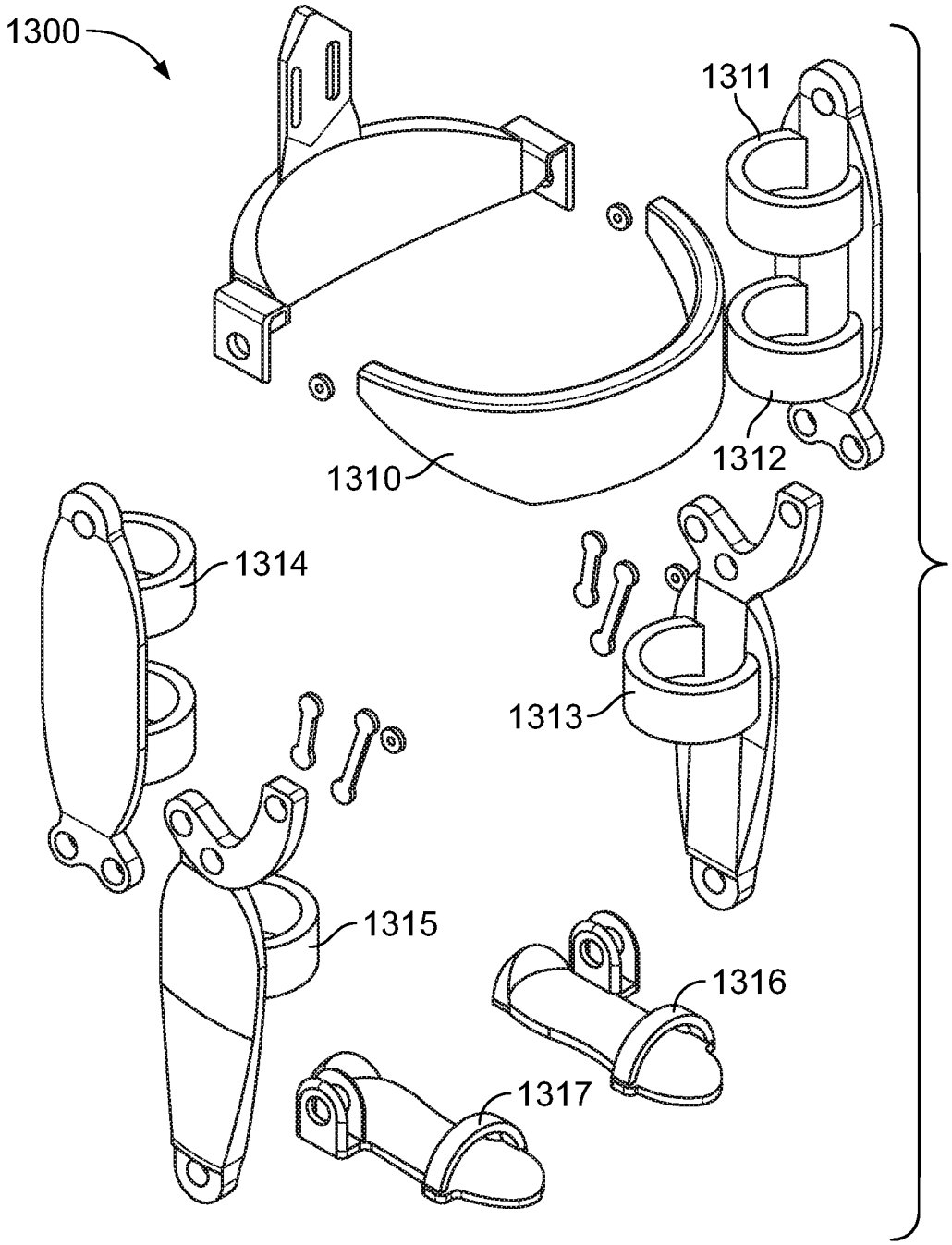
FIG. 13 illustrates an exploded view of the subsystems that may be used for an embodiment of the present invention.

FIG. 13 shows fastener system 1300 which include straps 1310-1317.

The fastener system preserves anatomical integrity of the patient during use. The strapping assists in several requirements as mentioned in each individual subsystem. Overall, the strapping functions to keep the patient firmly secured to the rigid components of the system.

In other embodiments, the present invention provides a system and method that includes a motorized or non-motorized walking assist system/device for persons who have balance issues (functional nervous and muscles but impaired brain signals) whereby the system is modular and progressive in nature allowing the user to have a range of support from the lower back to the bottom of the foot. The system and method are configurable to provide decreasing levels of lower trunk and leg support to train the brain to properly signal and engage the muscles to function normally.

In other embodiments, the present invention provides a system and method to assist a user having adequately functioning muscles and leg nerves to overcome an interruption of service between the brain and the legs whereby the system is modular and progressive in nature allowing the user to have a range of support from the lower back to the bottom of the foot. The system and method are configurable to provide decreasing levels of lower trunk and leg support to train the brain to properly signal and engage the muscles to function normally.

In a preferred method, the modular system comprises a back-support system, upper leg system, lower leg system and feet system described above. A patient using the system is first outfitted with all the subsystems. As the training and development of the patient progresses to a satisfactory condition, the back-support system is first removed. The remaining components are continued to be used with the patient until adequate progress is obtained. At this point, the upper leg system is removed and only the lower leg and feet systems remain. Again, the lower leg system and feet system are used in combination until adequate progress is obtained at which point the lower leg subsystem is removed leaving the foot subsystem. The foot subsystem remains in use until adequate progress is made at which point it may be removed.

In yet another preferred training method, the first piece to be removed from the waist subsystem is upwardly extending back support 710 which leaves section 720 and strap 730 in place to surround and support a user's hips and/or waist. The next steps of the method are as described above.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiments, methods, and examples, but by all embodiments and methods within the scope and spirit of the disclosure.

What is claimed is:

1. A system to assist a user to perform functions such as walking, comprising:

a plurality of subsystems configured to be progressively removed to provide decreasing levels of lower trunk and leg support;

said plurality of subsystems include a waist support subsystem, upper leg subsystem, lower leg subsystem and foot retention subsystem;

said waist support subsystem includes a curved base having two terminal ends, a top edge and a bottom edge, a vertical extension located in the middle of said curved base, a strap removably attached to one or both of said terminal ends;

said waist support subsystem connected to said upper leg subsystem by brackets and pins to form an articulating connection between said waist support subsystem and said upper leg subsystem;

said pins configured to be located at or near the hip joint when in use;

said top edge is configured to be located above the hip joint and said lower edge extends down into the glute when in use;

said waist support subsystem system further includes a rigid back support component with a vertical-extension that is configured to provide support up the small of the back;

said upper leg subsystem includes two elongated plates, said plates removably connected to said waist support system near said terminal ends,;

said lower leg subsystem includes two elongated plates, said plates removably connected to said upper leg subsystem to form an articulating connection; and said foot retention subsystem includes two foot retainers, said foot retainers removably connected to said lower leg subsystem to form an articulating connection.

2. The system of claim 1 wherein said waist-support subsystem includes a saddle to provide core support to maintain balance in a standing position.

3. The system of claim 1 wherein the upper leg subsystem allows for up to 12 degrees in hip flexion and up to 12 degrees of knee bend.

4. The system of claim 1 wherein the lower leg subsystem allows for up to 12 degrees of knee bend and for ±10 degrees of plantarflexion and dorsiflexion.

5. The system of claim 1 wherein the foot subsystem allows for ±10 degrees of plantarflexion and dorsiflexion.

6. The system of claim 1 wherein the system is configured to provide resistance in an inner thigh area.

7. The system of claim 1 wherein the system allows for up to 12 degrees of hip flexion and ±10 degrees of plantarflexion and dorsiflexion.

8. The method of claim 1 wherein the foot subsystem allows for ±10 degrees of plantarflexion and dorsiflexion.

9. The system of claim 1 further including at least one actuator connected between said waist subsystem and said lower leg subsystem.

10. A method to assist a user to perform functions such as walking, comprising the steps of:

providing a plurality of subsystems configured to be progressively removed to provide decreasing levels of lower trunk and leg support;

said plurality of subsystems include a waist support subsystem, upper leg subsystem, lower leg subsystem and foot retention subsystem;

said waist support subsystem includes a curved base having two terminal ends, a top edge and a bottom edge, a vertical extension located in the middle of said curved base, a strap removably attached to one or both of said terminal ends, said waist support subsystem is first removed;

said waist support subsystem connected to said upper leg subsystem by brackets and pins to form an articulating connection between said waist support subsystem and said upper leg subsystem;

said pins located at or near a hip joint when in use;

said top edge is located above the hip joint and said lower edge extends down into the glute when in use;

said waist support subsystem system further includes a rigid back support component with a vertical extension that provides support up a small of a back;

said upper leg subsystem includes two elongated plates, said plates removably connected to said waist support system near said terminal ends, said upper leg subsystem removed after said waist support subsystem;

said lower leg subsystem includes two elongated plates, said plates removably connected to said upper leg subsystem to form an articulating connection, said lower leg subsystem removed after said upper leg subsystem; and said foot retention subsystem includes two foot retainers, said foot retainers removably connected to said lower leg subsystem to form an articulating connection, said foot retainers removed after said lower leg subsystem.

11. The method of claim 10 wherein said waist-support subsystem includes a saddle to provide core support to maintain balance in a standing position.

12. The method of claim 10 wherein the upper leg subsystem allows for up to 12 degrees in hip flexion and up to 12 degrees of knee bend.

13. The method of claim 10 wherein the lower leg subsystem allows for up to 12 degrees of knee bend and for ±10 degrees of plantarflexion and dorsiflexion.

14. The method of claim 10 wherein the system engages leg adductor muscles by providing resistance in an inner thigh area.

15. The method of claim 10 wherein the system allows for up to 12 degrees of hip flexion and ±10 degrees of plantarflexion and dorsiflexion.

16. The method of claim 10 wherein said rigid back support of said waist support subsystem is removed before other components of said waist support subsystem are removed.

* * * * *